US008696526B1

(12) United States Patent
Dew

(10) Patent No.: US 8,696,526 B1
(45) Date of Patent: Apr. 15, 2014

(54) STATIONARY RECUMBENT BICYCLE DEVICE

(76) Inventor: Mario D. Dew, Richton Park, IL (US)

( * ) Notice: Subject to any disclaimer, the term of this patent is extended or adjusted under 35 U.S.C. 154(b) by 224 days.

(21) Appl. No.: 13/274,168

(22) Filed: Oct. 14, 2011

(51) Int. Cl.
*A63B 22/06* (2006.01)
*A63B 69/16* (2006.01)

(52) U.S. Cl.
USPC ..... 482/57

(58) Field of Classification Search
USPC ..... 482/51, 57–65, 80, 142; 606/240
See application file for complete search history.

(56) References Cited

U.S. PATENT DOCUMENTS 4,976,426 A 12/1990 Szabo et al.
5,928,116 A * 7/1999 Chiang ..... 482/72
6,547,701 B1 * 4/2003 Eschenbach ..... 482/57
7,588,518 B2 9/2009 LaStayo et al.
2003/0069110 A1 * 4/2003 Chang ..... 482/57
2004/0018923 A1 * 1/2004 Schiff ..... 482/142
2006/0189451 A1 8/2006 Nelson
2008/0032864 A1 * 2/2008 Hakki ..... 482/8

* cited by examiner

*Primary Examiner* — Loan Thanh
*Assistant Examiner* — Jennifer M Deichl

(57) ABSTRACT

The stationary recumbent bicycle device is foremost mechanically basic. Design was principally concerned with basic, sturdy construction to avoid any functional or structural failures. The horizontal backbones provide rigidity, especially being coupled to the centrally disposed box frame. The rigidity continues with the backbone riser and backbone angle, and on through the sturdy fork assembly. Importantly, the body rest and the headrest assembly are easily and quickly adjusted to user fit. By being recumbent, the device involves more musculature than does an upright bicycle.

2 Claims, 3 Drawing Sheets

FIG. 3
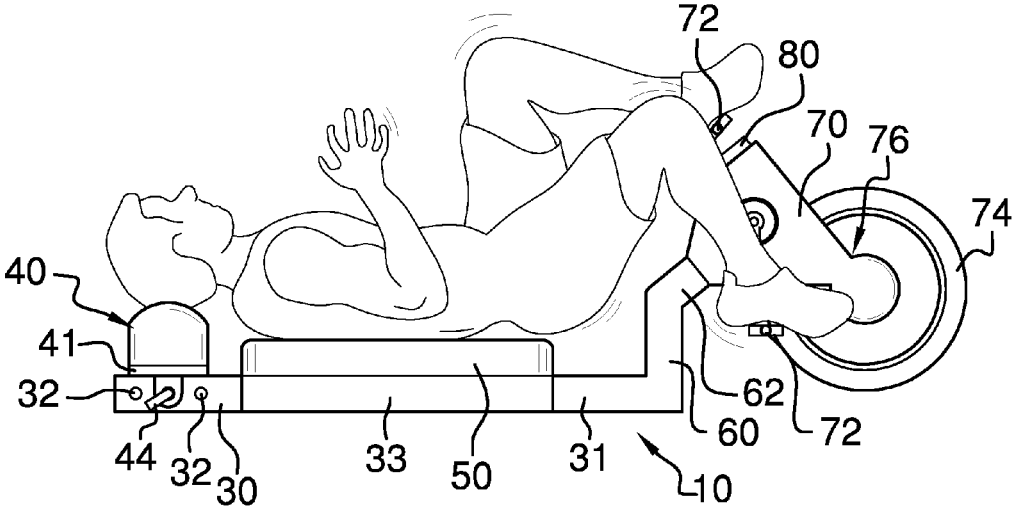
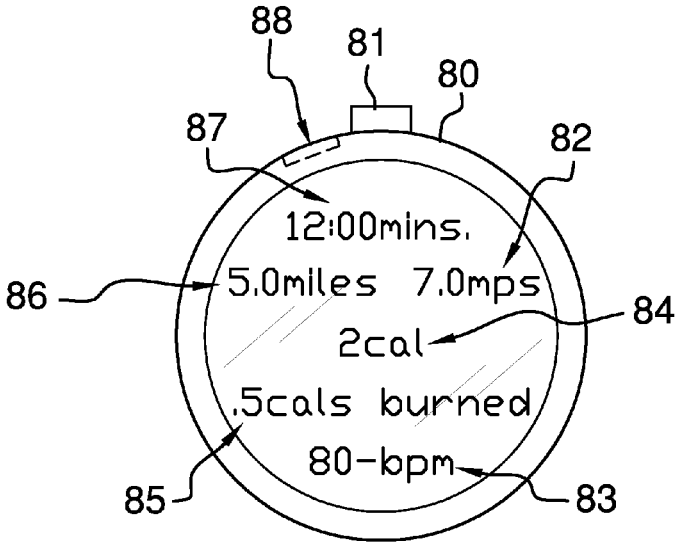
FIG. 4

STATIONARY RECUMBENT BICYCLE DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Exercise bicycles have become almost ubiquitous, especially in health clubs. Many exercise bicycles riders prefer recumbent bicycles to an upright. Most recumbent bicycles can involve more musculature in pedaling than can upright bicycles. A few problems have become well known with such exercise bicycles though. Among those problems are unreliability, whether mechanical or electronic. Another issue is inadequate structural sturdiness. Yet another problem is that some stationary exercise bicycles do not provide sufficient space for freedom of foot placement and rotation. The present device solves these problems. Additionally, many stationary exercise bicycles incorporate heart rate monitors that often fail. Stand alone heart rate monitors are generally superior, so the present invention provides for heart rate monitor communication from existing heart rate monitors.

FIELD OF THE INVENTION

The stationary recumbent bicycle device relates to stationary exercise bicycles and more especially to a recumbent stationary bicycle device with informative meter and sturdy, basic construction.

SUMMARY OF THE INVENTION

The general purpose of the stationary recumbent bicycle device, described subsequently in greater detail, is to provide a stationary recumbent bicycle device which has many novel features that result in an improved stationary recumbent bicycle device which is not anticipated, rendered obvious, suggested, or even implied by prior art, either alone or in combination thereof.

To attain this, the stationary recumbent bicycle device is foremost mechanically basic. The industry of stationary bicycles is fraught with devices that are not, the reason for the intense design concerns on basic, sturdy construction of the present device. The horizontal backbones provide rigidity, especially being coupled to the centrally disposed box frame. The rigidity continues with the backbone riser and backbone angle, and on through the sturdy fork assembly. Importantly, the body rest and the headrest assembly are easily and quickly adjusted to user fit. By being recumbent, the device involves more musculature than does an upright bicycle.

An embodiment even more basic than that illustrated may include a meter than indicates only a part of the illustrated meter indicators.

Thus has been broadly outlined the more important features of the improved stationary recumbent bicycle device so that the detailed description thereof that follows may be better understood and in order that the present contribution to the art may be better appreciated.

An object of the stationary recumbent bicycle device is to provide superior exercise.

Another object of the stationary recumbent bicycle device is to provide superior exercise in stationary form.

A further object of the stationary recumbent bicycle device is to provide a recumbent exercise position in order to involve more of a user's musculature.

An added object of the stationary recumbent bicycle device is to meter a user's functions.

And, an object of the stationary recumbent bicycle device is to be adjustable to a user's height and size.

A further object of the stationary recumbent bicycle device is to negate unneeded complexity.

Still another object of the stationary recumbent bicycle device is ensure complete freedom of foot and pedal movement without potential contact of feet with any other part of the device.

These together with additional objects, features and advantages of the improved stationary recumbent bicycle device will be readily apparent to those of ordinary skill in the art upon reading the following detailed description of presently preferred, but nonetheless illustrative, embodiments of the improved stationary recumbent bicycle device when taken in conjunction with the accompanying drawings.

BRIEF DESCRIPTION OF THE DRAWINGS

FIG. 3 is an in-use lateral elevation view.
FIG. 4 is a top plan view of the meter.

DETAILED DESCRIPTION OF THE DRAWINGS

With reference now to the drawings, and in particular FIGS. 1 through 5 thereof, the principles and concepts of the stationary recumbent bicycle device generally designated by the reference number 10 will be described.

Figure 1:
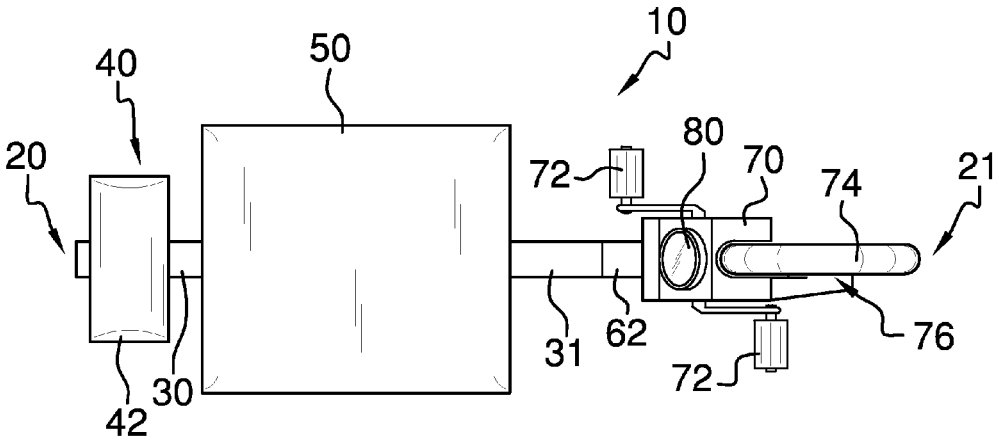
FIG. 1 is a top plan view.

Referring to FIG. 1, the device 10 partially comprises a first end 20 spaced apart from a second end 21. The first backbone section 30 is extended medially and horizontally from the first end 20.

Figure 5:
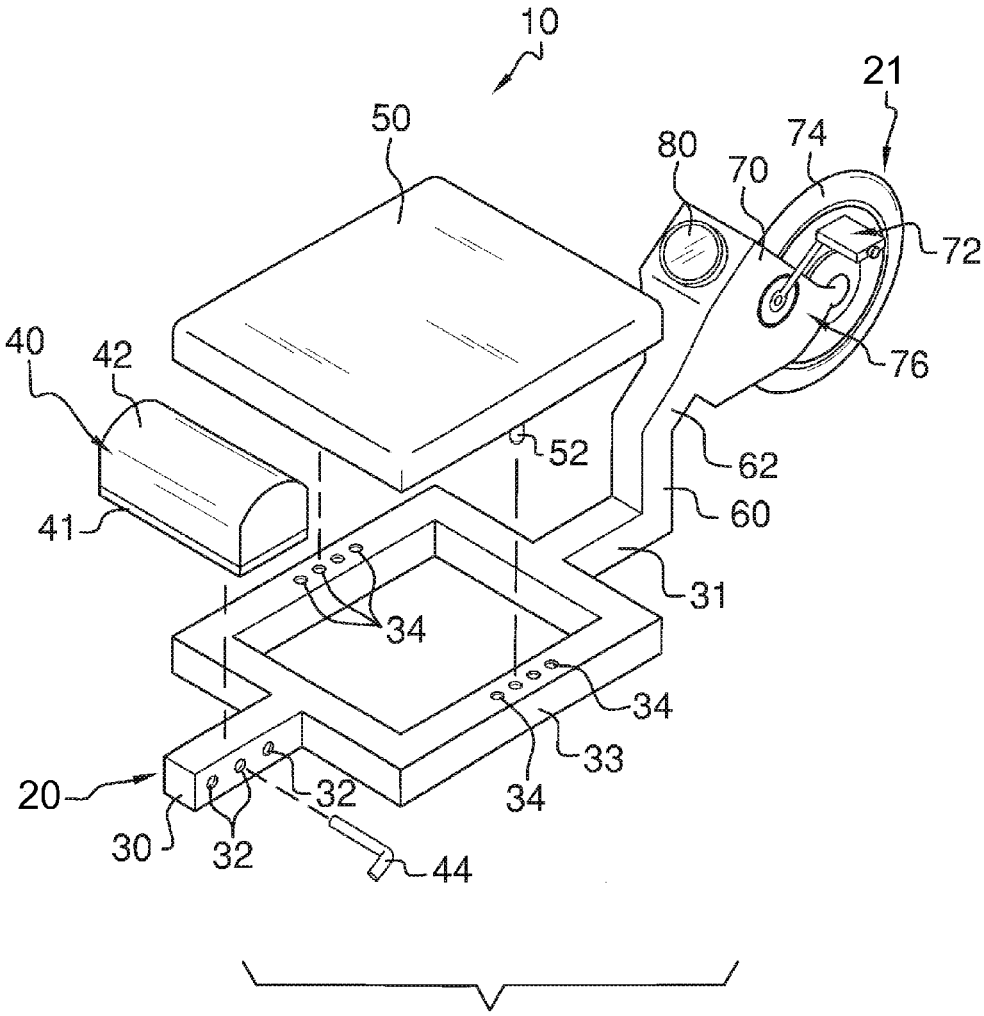
FIG. 5 is a partially exploded perspective view.

Referring to FIG. 5, a plurality of spaced apart horizontal orifices 32 is disposed in the first backbone section 30. The second backbone section 31 is disposed horizontally and coplanarly to the first backbone section 30. The second backbone section 31 is most proximal to the second end 21. The second backbone section 31 is spaced apart from the first backbone section 30. The horizontally disposed box frame 33 connects the first backbone section 30 to the second backbone section 31. A plurality of spaced apart vertical orifices 34 is disposed outwardly in an each side of the box frame 33.

Figure 2:
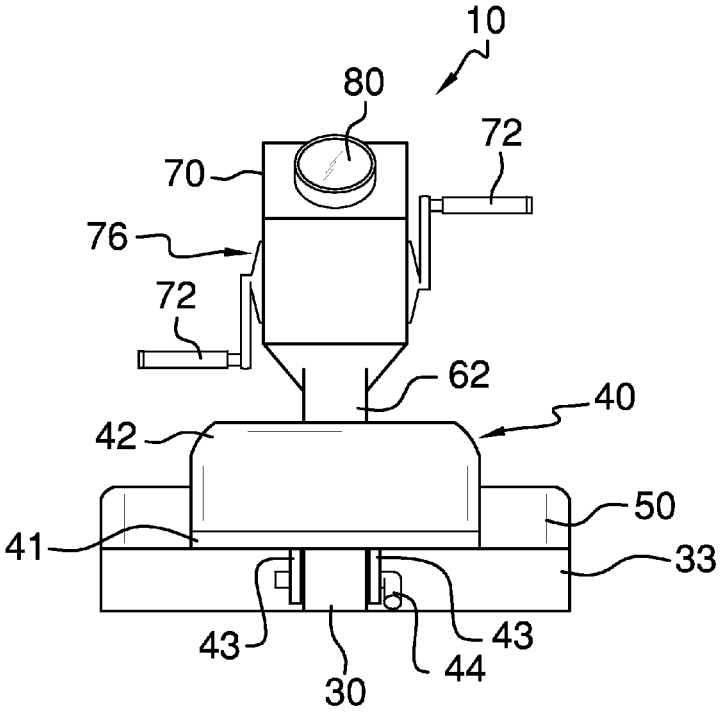
FIG. 2 is a first end elevation view.

Referring to FIG. 2, the headrest assembly 40 partially comprises a downwardly disposed headrest platform 41. The cushion 42 is disposed upwardly on the headrest platform 41. The pair of spaced apart centrally disposed ears 43 is extended perpendicularly downward from the headrest assembly 40. The ears 43 removably straddle the first backbone section 30. The pin 44 is removably passed through the ears 43 and through a one of the plurality of first backbone section 30 horizontal orifices 32.

Referring again to FIG. 5, the padded body rest 50 is provided. The pair of spaced apart rest pins 52 is disposed outwardly and downwardly on the padded body rest 50. The rest pins 52 are selectively and removably inserted into the box frame 33 vertical orifices 34 in selectively locating the padded body rest 50 atop the box frame 33.

Referring to FIG. 3 and FIG. 5, the backbone riser 60 is affixed perpendicularly upward to the second backbone section 31 and most proximal to the second end 21. The backbone angle 62 is affixed forwardly and angularly upward to the backbone riser 60. The fork assembly 70 is affixed downwardly and angularly forward to the backbone angle 62.

Referring to FIG. 2, the pedal assembly 72 is affixed through the fork assembly 70. The wheel 74 is affixed forwardly downward within the fork assembly 70.

Referring to FIG. 3, the adjustable resistance mechanism 76 is disposed within the fork assembly 70 proximal to the wheel 74.

Referring to FIG. 1 and to FIG. 4, the meter 80 is disposed upwardly within the fork assembly 70. The meter 80 is in communication with the adjustable resistance mechanism 76. The meter 80 further comprises a reset 81, a speed indicator 82, a heart rate indicator 83, a calorie expenditure rate indicator 84, a total caloric expenditure indicator 85, a distance indicator 86, a time involved indicator 87, and a monitor plug 88. Various existing heart rate monitors may be plugged into the monitor plug 88.

Referring to FIG. 3, the user is importantly assured of no contact of his feet with any part of the device 10 other than the pedal assembly 72 by virtue of the design of the backbone riser 60, the backbone angle 62, and the fork assembly 70.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the stationary recumbent bicycle device may be used.

What is claimed is:

1. A stationary recumbent bicycle device comprising, in combination:

a first end spaced apart from a second end;

a first backbone section extended medially and horizontally from the first end;

a plurality of spaced apart horizontal orifices disposed in the first backbone section;

a second backbone section disposed horizontally and coplanarly to the first backbone section, the second backbone section most proximal to the second end, the second backbone section spaced apart from the first backbone section;

a horizontally disposed box frame connecting the first backbone section to the second backbone section;

a plurality of spaced apart vertical orifices disposed outwardly in an each side of the box frame;

a headrest assembly comprising:

a headrest platform placed on the first backbone section;

a cushion disposed upwardly on the headrest platform;

a pair of spaced apart centrally disposed ears extended perpendicularly downward, the ears removably straddling the first backbone section;

a pin removably passed through the ears and through a one of the plurality of the first backbone section horizontal orifices;

a padded body rest;

a pair of spaced apart rest pins disposed outwardly and downwardly on the padded body rest, the rest pins selectively and removably inserted into the box frame vertical orifices in locating the padded body rest atop the box frame;

a backbone riser affixed perpendicularly upward to the second backbone section and most proximal to the second end;

a backbone angle affixed forwardly and angularly upward to the backbone riser;

a fork assembly affixed downwardly and angularly forward to the backbone angle;

a pedal assembly affixed through the fork assembly;

a wheel affixed forwardly downward within the fork assembly;

an adjustable resistance mechanism disposed within the fork assembly proximal to the wheel;

a meter disposed upwardly within the fork assembly, the meter in communication with the adjustable resistance mechanism, the meter further comprising a reset and a speed indicator and a distance indicator.

2. A stationary recumbent bicycle device comprising, in combination:

a first end spaced apart from a second end;

a first backbone section extended medially and horizontally from the first end;

a plurality of spaced apart horizontal orifices disposed in the first backbone section;

a second backbone section disposed horizontally and coplanarly to the first backbone section, the second backbone section most proximal to the second end, the second backbone section spaced apart from the first backbone section;

a horizontally disposed box frame connecting the first backbone section to the second backbone section;

a plurality of spaced apart vertical orifices disposed outwardly in an each side of the box frame;

a headrest assembly comprising:

a headrest platform placed on the first backbone section;

a cushion disposed upwardly on the headrest platform;

a pair of spaced apart centrally disposed ears extended perpendicularly downward, the ears removably straddling the first backbone section;

a pin removably passed through the ears and through a one of the plurality of the first backbone section horizontal orifices;

a padded body rest;

a pair of spaced apart rest pins disposed outwardly and downwardly on the padded body rest, the rest pins selectively and removably inserted into the box frame vertical orifices in locating the padded body rest atop the box frame;

a backbone riser affixed perpendicularly upward to the second backbone section and most proximal to the second end;

a backbone angle affixed forwardly and angularly upward to the backbone riser;

a fork assembly affixed downwardly and angularly forward to the backbone angle;

a pedal assembly affixed through the fork assembly;

a wheel affixed forwardly downward within the fork assembly;

an adjustable resistance mechanism disposed within the fork assembly proximal to the wheel;

a meter disposed upwardly within the fork assembly, the meter in communication with the adjustable resistance mechanism, the meter further comprising:

a reset;
a speed indicator;
a heart rate indicator;
a calorie expenditure rate indicator;
a total caloric expenditure indicator;
a distance indicator;
a time involved indicator;
a monitor plug.

* * * * *